US010514035B2

(12) United States Patent
Hemphill et al.

(10) Patent No.: US 10,514,035 B2
(45) Date of Patent: Dec. 24, 2019

(54) INTEGRATED ECCENTRIC MOTOR AND PUMP

(71) Applicant: Schaeffler Technologies AG & Co. KG, Herzogenaurach (DE)

(72) Inventors: Jeffrey Hemphill, Copley, OH (US); Philip George, Wooster, OH (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 417 days.

(21) Appl. No.: 15/155,665

(22) Filed: May 16, 2016

(65) Prior Publication Data

US 2017/0328362 A1 Nov. 16, 2017

(51) Int. Cl.
*F04C 15/00* (2006.01)
*F04C 2/10* (2006.01)

(52) U.S. Cl.
CPC ..... *F04C 15/008* (2013.01); *F04C 2/103* (2013.01); *F04C 2/105* (2013.01)

(58) Field of Classification Search
USPC ..... 418/164, 166, 61.3
See application file for complete search history.

(56) References Cited

U.S. PATENT DOCUMENTS 1,444,577 A * 2/1923 Wilson ..... F04C 9/00 417/482
2,760,348 A * 8/1956 McAdam ..... F04C 18/10 417/356
3,443,378 A * 5/1969 Goff ..... B62D 5/097 418/171
3,490,383 A * 1/1970 Parrett ..... F04C 2/103 418/149
3,873,248 A * 3/1975 Johnson ..... F01C 1/104 137/625.2
4,193,746 A * 3/1980 Aman, Jr. ..... F04C 14/04 418/32
4,619,588 A * 10/1986 Moore, III ..... F04C 15/0053 310/154.14
5,062,776 A * 11/1991 Dlugokecki ..... F04C 2/105 418/61.3

(Continued)

*Primary Examiner* — Peter J Bertheaud
*Assistant Examiner* — Geoffrey S Lee
(74) *Attorney, Agent, or Firm* — Davidson, Davidson & Kappel, LLC

(57) ABSTRACT

A pump is provided. The pump includes a fluid inlet section; a fluid outlet section; a stator axially between the fluid inlet section and the fluid outlet section; a rotor axially between the fluid inlet section and the fluid outlet section, the rotor and the stator defining a fluid flow space radially therebetween; a movable inlet guide configured for guiding fluid flow from the fluid inlet section into the fluid flow space; and a movable outlet guide configured for guiding fluid flow from the fluid flow space into the fluid outlet section. The rotor is rotatable inside of the stator by electromagnetic forces urging the rotor towards the stator. Rotation of the rotor inside of the stator and movement of the inlet guide and the outlet guide create a pressure in a first portion of the fluid flow space that forces fluid from the fluid flow space through the fluid outlet section and create a vacuum in a second portion of the fluid flow space that pulls fluid from the fluid inlet section into the fluid flow space. A method of forming a pump is also provided.

20 Claims, 6 Drawing Sheets

(56) References Cited

U.S. PATENT DOCUMENTS 5,145,329 A * 9/1992 Zumbusch ..... F02M 37/041 417/356
5,201,645 A * 4/1993 Steele ..... F04C 29/0057 418/14
5,205,721 A * 4/1993 Isaacson ..... F04D 3/00 310/184
5,211,546 A * 5/1993 Isaacson ..... F04D 13/0646 415/900
5,476,374 A * 12/1995 Langreck ..... F04C 2/102 418/171
5,711,408 A * 1/1998 Dick ..... F04C 14/04 192/85.01
6,109,887 A 8/2000 Takura et al.
7,641,457 B2 * 1/2010 Asai ..... F01C 21/02 310/40 R
8,038,423 B2 * 10/2011 Nakayoshi ..... F04C 2/086 310/261.1
8,376,720 B2 * 2/2013 Rosalik, Jr. ..... F04C 2/10 417/356
8,408,881 B2 * 4/2013 Crotti ..... F04C 28/06 417/223
8,905,735 B2 * 12/2014 Holtzapple ..... F01C 1/103 418/104
2006/0051229 A1 * 3/2006 Thoms ..... F04C 2/102 418/61.3
2007/0231176 A1 * 10/2007 Asai ..... F01C 21/02 418/61.2
2011/0200477 A1 * 8/2011 Chua ..... F04C 2/084 418/136
2012/0034107 A1 * 2/2012 Crotti ..... F04C 28/06 417/212
2014/0112813 A1 * 4/2014 Gilbert ..... F01C 1/10 418/1
2014/0119963 A1 5/2014 Hadar et al.
2015/0152732 A1 * 6/2015 Holtzapple ..... F01C 1/103 418/61.3
2015/0288249 A1 10/2015 Hemphill et al.

* cited by examiner

INTEGRATED ECCENTRIC MOTOR AND PUMP

The present disclosure relates generally to pump and more specifically to pumps of automotive vehicle transmissions.

BACKGROUND

U.S. Pat. No. 6,109,887 discloses a pump including an integrated motor and rotor. U.S. Pub. No. 2014/0119963 discloses an integrated electric oil pump including a gerotor pump. U.S. Pub. No. 2015/0288249 discloses an eccentric motor.

SUMMARY OF THE INVENTION

A pump is provided. The pump includes a fluid inlet section; a fluid outlet section; a stator axially between the fluid inlet section and the fluid outlet section; a rotor axially between the fluid inlet section and the fluid outlet section, the rotor and the stator defining a fluid flow space radially therebetween; a movable inlet guide configured for guiding fluid flow from the fluid inlet section into the fluid flow space; and a movable outlet guide configured for guiding fluid flow from the fluid flow space into the fluid outlet section. The rotor is rotatable inside of the stator by electromagnetic forces urging the rotor towards the stator. Rotation of the rotor inside of the stator and movement of the inlet guide and the outlet guide create a pressure in a first portion of the fluid flow space that forces fluid from the fluid flow space through the fluid outlet section and create a vacuum in a second portion of the fluid flow space that pulls fluid from the fluid inlet section into the fluid flow space.

A method of forming a pump is also provided. The method includes providing a rotor radially inside of a stator; rotatably fixing a movable inlet guide to a first axial side of the rotor; rotatably fixing a movable outlet guide to second axial side of the rotor; providing a fluid inlet section upstream of the movable inlet guide; and providing a fluid outlet section downstream of the movable outlet guide, the rotor and the stator defining a fluid flow space radially therebetween, the movable inlet guide configured for guiding fluid flow from the fluid inlet section into the fluid flow space, the movable outlet guide configured for guiding fluid flow from the fluid flow space into the fluid outlet section, the rotor being rotatable inside of the stator by electromagnetic forces urging the rotor towards the stator, rotation of the rotor inside of the stator and movement of the inlet guide and the outlet guide creating a pressure in a first portion of the fluid flow space that forces fluid from the fluid flow space through the fluid outlet section and creating a vacuum in a second portion of the fluid flow space that pulls fluid from the fluid inlet section into the fluid flow space.

BRIEF DESCRIPTION OF THE DRAWINGS

The present invention is described below by reference to the following drawings, in which.

DETAILED DESCRIPTION

The disclosure provides a space-saving electrically driven auxiliary pump including a rotor and stator of a motor that are dual purposed as the rotor and stator of the pump. The rotor is positioned inside the stator using a gerotor pump, for example, or internal gear pump, vane pump, or several other pump types. An electric current is sent through at least four stator windings to create a magnetic field pulling the rotor towards that coil in order to complete a magnetic circuit formed by the legs of the stator. Movement of the rotor towards the coil displaces fluid thus creating pressure, and a vacuum is created on the other side of the rotor. As the rotor travels toward the first coil, the next coil is energized to roll the rotor around the inside of the stator pumping fluid from inlet to outlet. Plates serve to align the high pressure side with the outlet and the low pressure side with the inlet.

Figure 1:
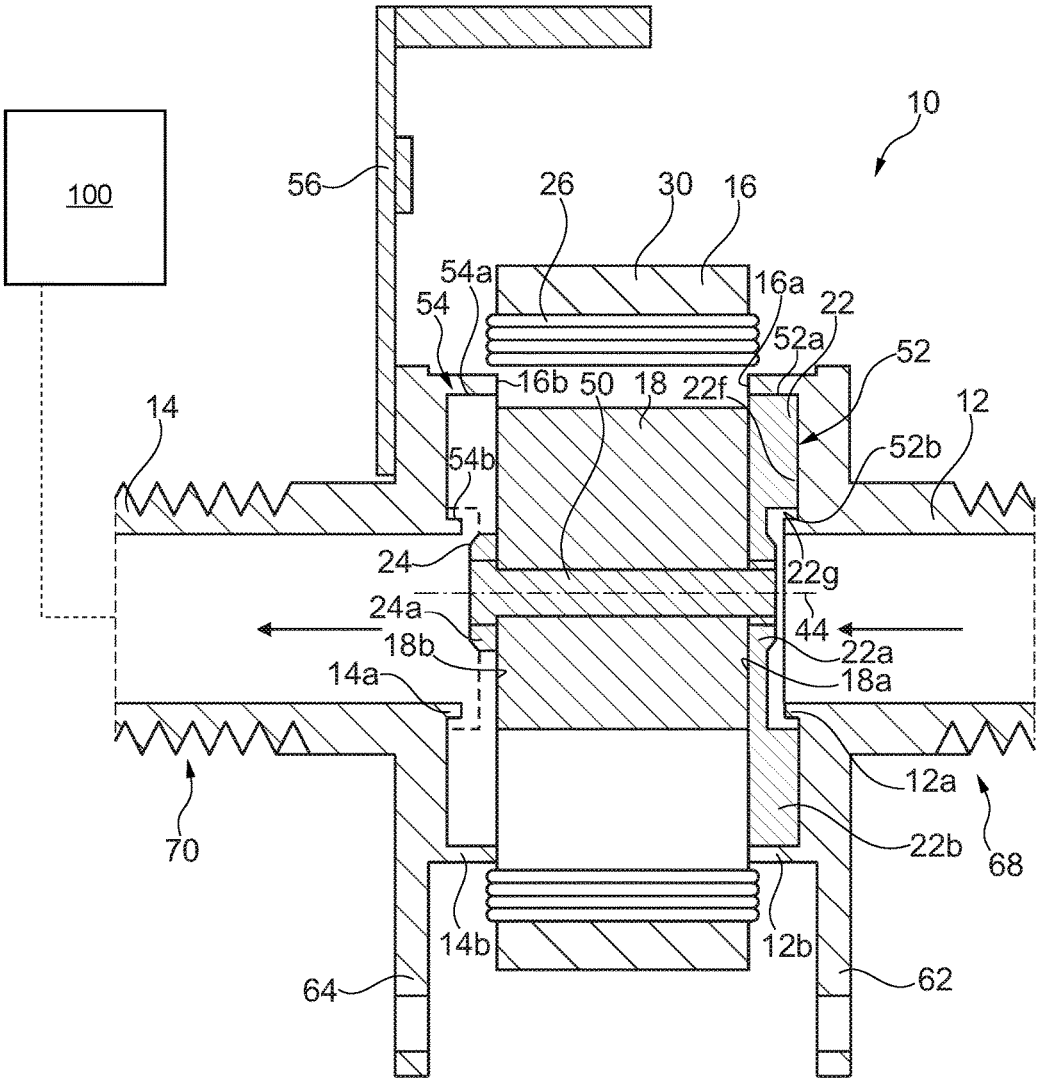
FIG. 1 schematically shows a cross-sectional side view of a pump for an automotive vehicle transmission according to an embodiment of the present invention.
Figure 2:
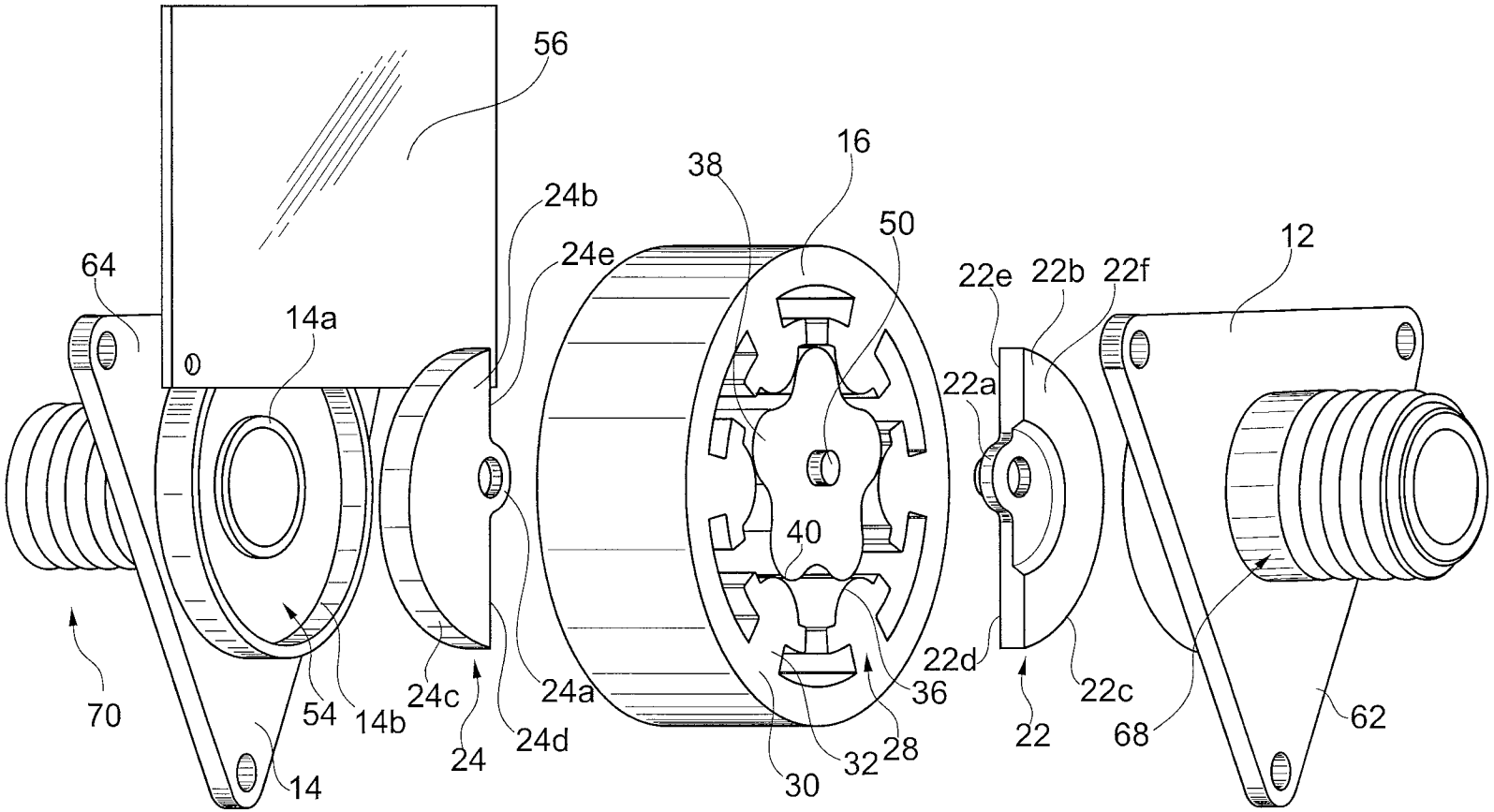
FIG. 2 shows an exploded cross-sectional perspective view of the pump shown in FIG. 1.

FIG. 1 schematically shows a cross-sectional side view of a pump 10 for an automotive vehicle transmission 100 according to an embodiment of the present invention and FIG. 2 shows an exploded cross-sectional perspective view of pump 10. Pump 10 may be used in other contexts besides an automotive vehicle transmission. Pump 10 includes a fluid inlet section 12 of the housing, a fluid outlet section 14 of the housing, a stator 16 axially between fluid inlet section 12 and fluid outlet section 14 and a rotor 18 axially between fluid inlet section 12 and the fluid outlet section 14. Rotor 18 and stator 16 define a fluid flow space 20 radially therebetween. Pump 10 also includes a movable inlet guide 22 configured for guiding fluid flow from fluid inlet section 12 into fluid flow space 20 and a movable outlet guide 24 configured for guiding fluid flow from fluid flow space 20 into fluid outlet section 14.

Stator 16 is provided with a plurality of electrical windings 26 for generating electromagnetic forces in stator 16 to urge rotor 18 toward stator 16 such that rotor 18 rotates inside of stator 16. In this embodiment, stator 16 is provided with six electrical windings 26, but in other embodiments, stator 16 may be provided with any other amounts of windings 26 greater than three. Windings 26 are each wrapped around one of legs 28 of stator 16. Stator 16 includes a cylindrical ring 30 defining an outer circumference of stator 16, with each leg 28 protruding radially inward from cylindrical ring 30. Legs 28 each include a base 32 extending radially inward from an inner circumference of cylindrical ring 30, two branches 34 extending circumferentially from a radially inner end of base 32 in opposite circumferential directions, and a rounded radially innermost tip 36 protruding radially inward from branches 34. Windings 26 are wrapped around base 32 and held radially in place by the inner circumferential surface of cylindrical ring 30 and the outer circumferential surfaces of branches 34 and insulation layers may be provided over windings 26 to insulate windings from fluid flow space 20.

Rotor 18 in this embodiment is substantially star shaped and includes a plurality of radially outwardly extending protrusions 38. In this embodiment, rotor 18 includes five protrusions 38, but in other embodiments rotor 18 may include other amounts of protrusions 38, with the amount of protrusions 38 being one less than the number of windings 26. Protrusions 38 each include a radially outermost rounded tip 40. Rotor 18 is configured such that during rotation thereof, protrusions 38 sequentially enter into slots 42 between protrusions 38 to continuously vary the configuration of fluid flow space 20. When an electric current is sent through any one of windings 26 a magnetic field is created which pulls rotor 18 toward that winding 26 in order to complete a magnetic circuit formed by the legs 28 of the stator. As rotor 18 moves toward the winding 26, rotor 18 displaces fluid, with which fluid flow space 20 between the rotor and stator is filled, creating pressure. The movement of rotor 18 within stator 16 separates fluid flow space 20 into a first portion 20*a* that is pressurized to force fluid out of outlet section 14 and a second portion 20*b* that forms a vacuum to draw fluid into fluid flow space 20 from inlet section 12. As rotor 18 rotates within stator 16, the locations of first portion 20*a* and second portion 20*b* rotate about a center axis 44, with first portion 20*a* being oriented on the opposite radial side of rotor 18 as second portion 20*b* during the rotation.

Figure 3:
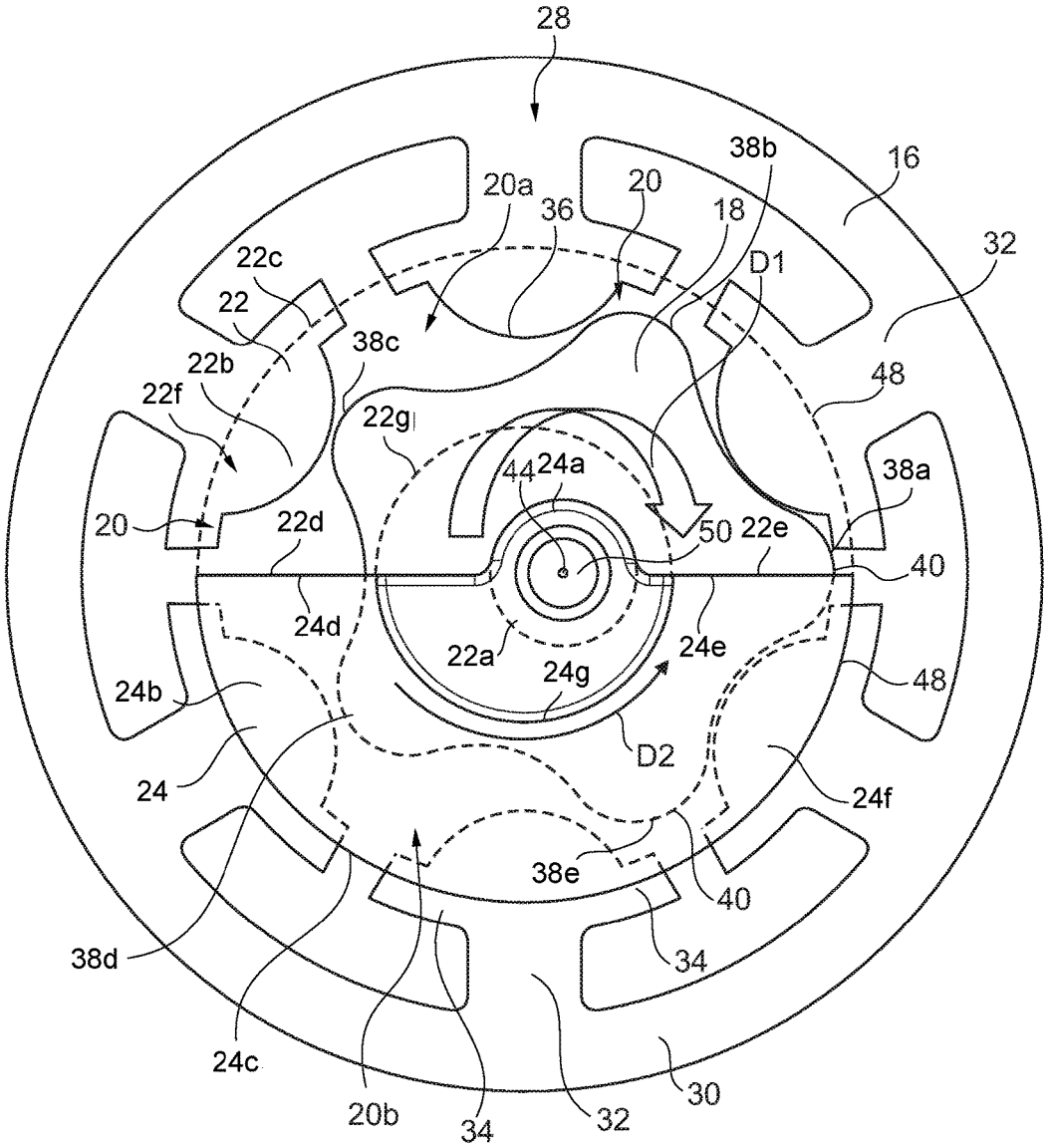
FIG. 3 shows a plan view of the stator, rotor, an inlet plate and an outlet plate of the pump shown in FIGS. 1 and 2.

In order to properly align inlet section 12 with second portion 20*b* while isolating inlet section 12 from first portion 20*a*, pump 10 includes movable inlet guide in the form of an inlet plate 22 upstream from rotor 18. In order to properly align outlet section 14 with first portion 20*a* while isolating outlet section 14 from second section 20*b*, pump 10 includes a movable outlet guide in the form of an outlet plate 24 downstream from rotor 18. Inlet plate 22 is configured to move to align the second portion 20*b* of fluid flow space 20 with fluid inlet section 12 and outlet plate 24 is configured to move to align first portion 20*a* of fluid flow space 20 with the fluid outlet section 14. More specifically, plates 22, 24 are rotatably fixed to rotor 18 such that plates 22, 24 are configured to rotate about center axis 44 in the opposite direction as rotor 18 is rolling along stator 16. Plates 22, 24 are circumferentially offset from each other and on diametrically opposite radial sides of center axis 44 when viewed cross-sectionally in the axial direction. FIG. 3 illustrates an axially facing cross-sectional view stator 16, rotor 18, inlet plate 22 and outlet plate 24 from the fluid inlet side of pump 10. As shown in FIG. 3, plates 22, 24 are arranged in a complementary manner to form a circle, with each plate 22, 24 having a semi-circular cross section as define by the outer circumference of each plate 22, 24. Rotor 18 rotates about axis 44 in a rotational direction D1 while plates 22, 24 rotate about axis 44 in rotational direction D2.

Fluid from the high pressure side, i.e., portion 20*a*, is pushed past outlet plate 24 and out the outlet section 14. At the same time, fluid is drawn in through inlet section 12 past inlet plate 22, filling the vacuum side, i.e., portion 20*b* of rotor 18. When rotor 18 is travelling toward a first winding 26, the next winding 26 is energized and the process continues, rolling rotor 18 around the inside of stator 16 and pumping fluid from inlet section 12 to outlet section 14. Because the high and low pressure sides are continuously moving around stator 16, the plates are used to align the high pressure side with the outlet and the low pressure side with the inlet. Plates 22, 24 are centered on lips 12*a*, 12*b* of inlet section 12 and lips 14*a*, 14*b* of outlet section 14, respectively, and are driven by a pin 50 in rotor 18. This causes plates 22, 24 to rotate in the opposite direction that rotor 18 is rolling, maintaining alignment with the correct pressures.

Plates 22, 24 are fixed together and to rotor 18 by a pin 50 extending axially through rotor 18 and defining center axis 44. Rotor 18 is mounted eccentrically on pin 50 such that rotor 18 rotates eccentrically about center axis 44 during operation of pump 10. Inlet plate 22 is mounted on a first axial end of pin 50 and plate 24 is mounted on a second axial end of pin 50. Inlet section 12 includes an annular groove 52 for guiding the rotation of plate 22 and outlet section 14 similarly includes an annular groove 54 for guiding the rotation of plate 24. The rotation of rotor 18 causes plates 22, 24 to slide in respective annular grooves 52, 54 such that the outer circumference of each plate 22, 24 moves circumferentially, but does not move radially, while pin 50 and center axis 44 follow a circular path P (FIGS. 4*a* to 4*c*) due to the eccentric placement of pin 50 on plates 22, 24.

Plates 22, 24 each include a connecting portion 22*a*, 24*a* and a guide portion 22*b*, 24*b* eccentrically fixed to the respective connecting portion 22*a*, 24*a*. Guide portions 22*b*, 24*b* each include a respective outer circumferential surface 22*c*, 24*c*, a respective longer radially extending surface 22*d*, 24*d* extending radially from the respective connecting portion 22*a*, 24*a* to a first edge of the respective outer circumferential surface 22*c*, 24*c* and a short radially extending surface 22*e*, 24*e* extending radially from the respective connecting portion 22*a*, 24*a* to a second edge of the respective outer circumferential surface 22*c*, 24*c*.

Each guide portion 22*b*, 24*b* also includes an axially protruding arc-shaped lip 22*f*, 24*f* configured for sliding in the respective annular groove 52, 54. Outer circumferential surfaces 22*c*, 24*c* of lips 22*f*, 24*f* slide along an outer circumferential surface 52*a*, 54*a* of the respective groove 52, 54 and inner circumferential surfaces 22*g*, 24*g* of lips 22*f*, 24*f* slide along an inner circumferential surface 52*b*, 54*b* of the respective groove 52, 54. Inner circumferential surface 52*b* of annular groove 52 is defined by an annular inner circumferential lip 12*a* of inlet section 12 and outer circumferential surface 52*a* of annular groove 52 is defined by an annular outer circumferential lip 12*b* of inlet section 12. Similarly, inner circumferential surface 54*b* of annular groove 54 is defined by an annular inner circumferential lip 14*a* of outlet section 14 and outer circumferential surface 54*a* of annular groove 54 is defined by an annular outer circumferential lip 14*b* of outlet section 14.

Inlet plate 22 is axially in contact with a radially extending inlet side surface 18*a* of rotor 18 and an inner portion of a radially extending inlet side surface 16*a* of stator 16 and outlet plate 24 is axially in contact with a radially extending outlet side surface 18*b* of rotor 18 and an inner portion of a radially extending outlet side surface 16*b* of stator 16. Annular outer circumferential lip 12*b* of inlet section 12 also contacts radially extending inlet side surface 16*a* of stator 16 and annular outer circumferential lip 14*b* of outlet section 14 contacts radially extending outlet side surface 16*b* of stator 16. Inlet and outlet sections 12, 14 are provided with respective flanges 62, 64, which in this embodiment are triangular, that include through holes for receiving fasteners for clamping sections 12, 14 axially together onto stator 16. Protruding axially outward from flanges 62, 64, respectively, inlet and outlet sections 12, 14 include respective male threaded tubes 68, 70 for connecting to corresponding female threaded components.

Figure 4A:
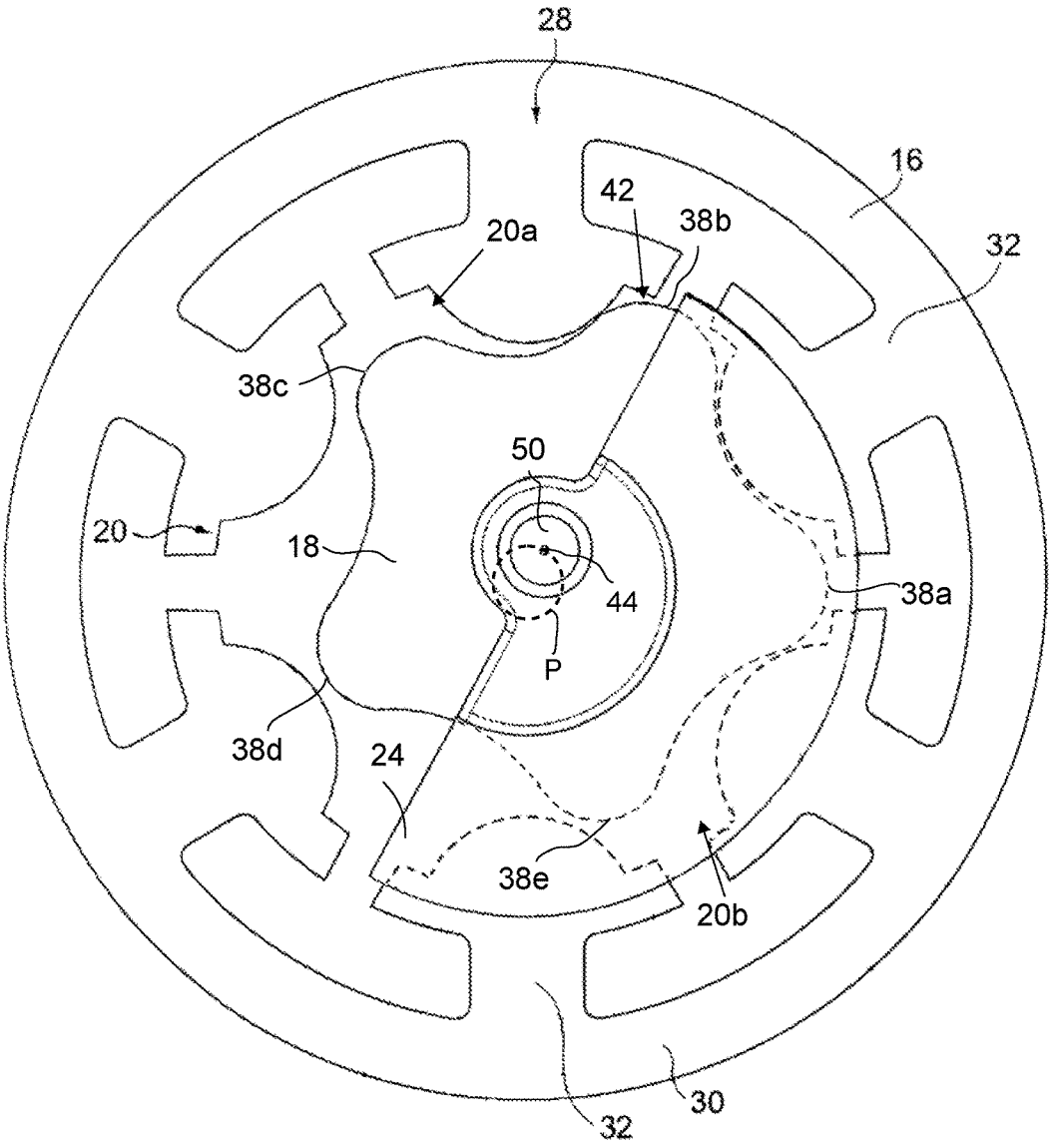
FIGS. 4*a* to 4*c* schematically show different positons of the rotor and the oulet plate during operation.
Figure 4B:
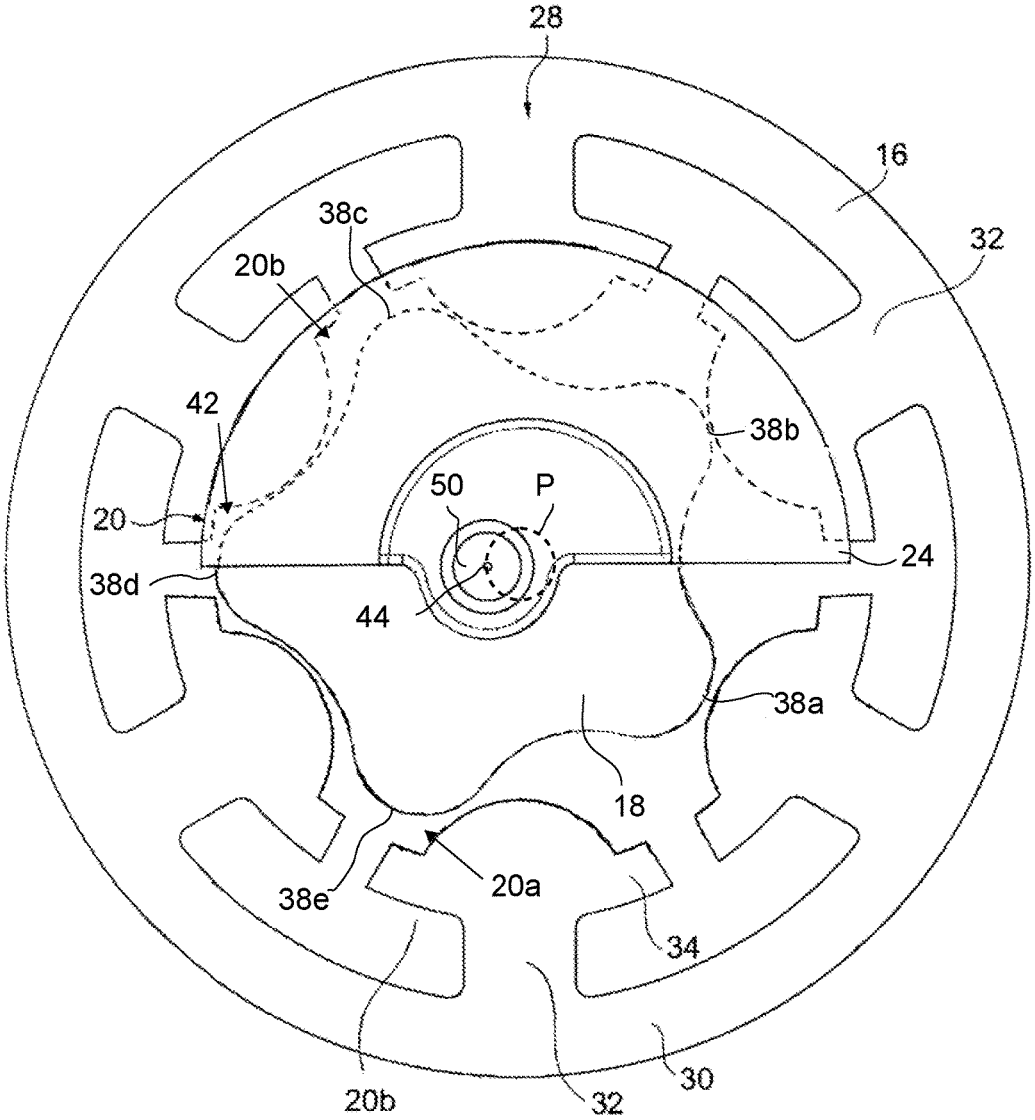
Figure 4C:
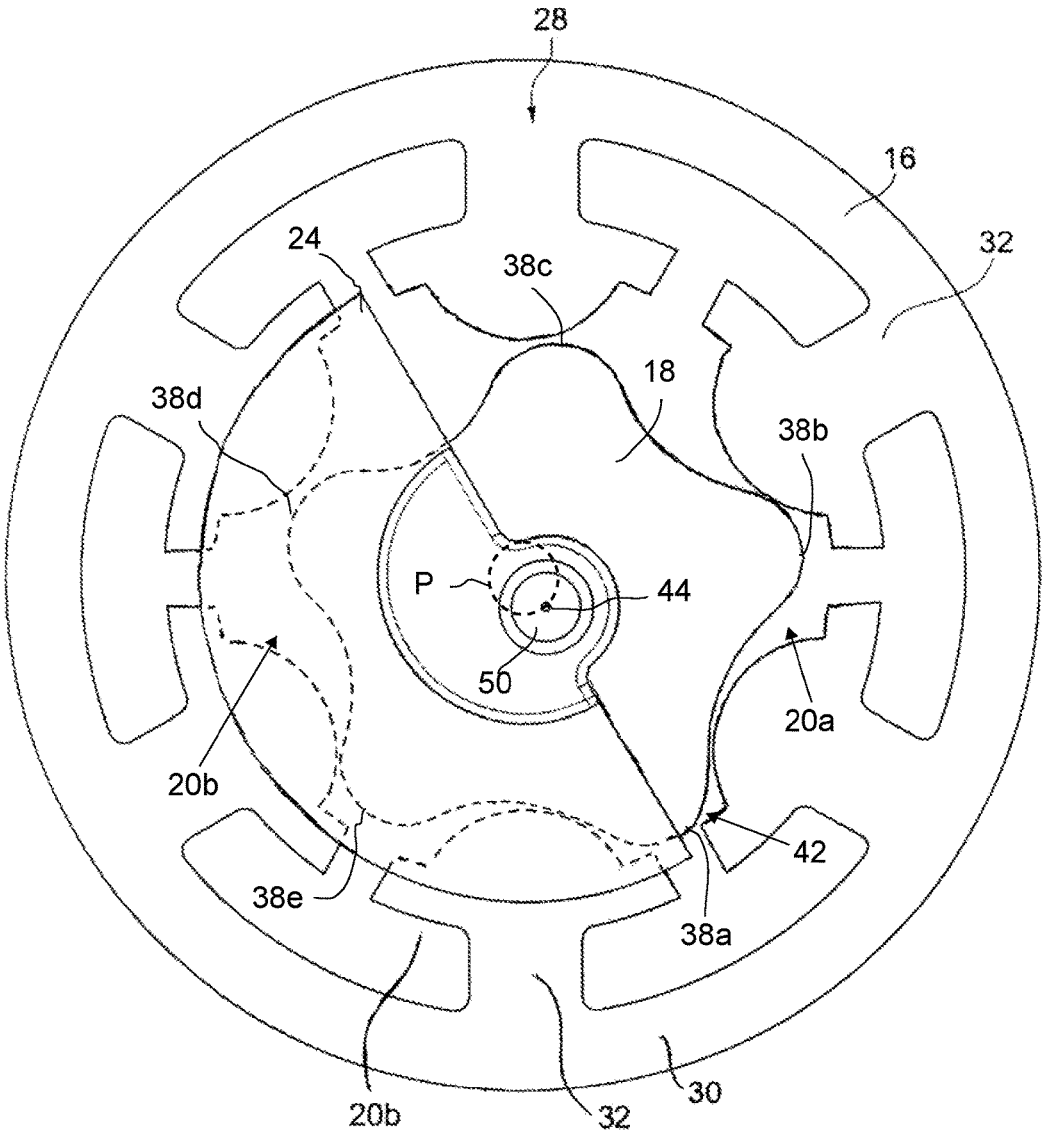

FIGS. 3 and 4*a* to 4*c* illustrate successive positions of rotor 18 and plate 24 (plate 22 is omitted from FIGS. 4*a* to 4*c* for clarity). To distinguish protrusions 38, each protrusion 38 has been given a unique reference character 38*a* to 38*e* in FIGS. 3 and 4*a* to 4*c*. From the position in FIG. 3, where a protrusion 38*a* is pulled into one of slots 42, to the position in FIG. 4*a*, plate 24 has rotated approximately 60 degrees in direction D2 and protrusion 38*b* is pulled into one of slots 42. From the position in FIG. 4*a* to the position in FIG. 4*b*, plate 24 has rotated approximately 120 degrees and protrusion 38*d* is pulled into one of slots 42. From the position in FIG. 4*b* to the position in FIG. 4*c*, plate 24 has rotated approximately 120 degrees and protrusion 38*a* is pulled into one of slots 42 that is adjacent clockwise to the slot 42 protrusion 38*a* was in in FIG. 3.

As the rotor 18 rotates about axis 44 in direction D1, rotor 18 rolls along stator 16 in direction D2, i.e., in a counterclockwise order, protrusions 38 of rotor 18 enter into slots 42. In other words, following the view in FIG. 3—where protrusion 38*a* is in the slot 42 at the ~3 o'clock position, after rotor 18 rotates about axis 44 in direction D1, the next protrusion 38*b* in counterclockwise direction enters into the slot at the ~1 o'clock position (as shown in FIG. 4*a*); then the next protrusion 38*c* in counterclockwise direction enters into the slot 42 at the ~11 o'clock position; the next protrusion 38*d* in counterclockwise direction enters into the slot 42 at the ~9 o'clock position (as shown in FIG. 4*b*); the next protrusion 38*e* in counterclockwise direction enters into the slot at the ~7 o'clock position; then protrusion 38*a* enters into the slot 42 at the ~5 o'clock position (as shown in FIG. 4*c*). As rotor 18 is rotated, plates 22, 24 are moved via the rotation of axis 44 in the circular path P (FIGS. 4*a* to 4*c*) due to inlet plate 22 and outlet plate 24 being eccentrically oriented with respect to the pin 50. The movement in path P via the rotation of rotor 18 causes plates 22, 24 to slide in respective annular grooves 52, 54 (FIG. 2) such that the outer circumference 22*c*, 24*c* (FIG. 3) of each plate 22, 24 moves circumferentially in direction D2, but does not move radially. As plates 22, 24 are arranged in a complementary manner to form a circle, the movement of plate 22 can be easily understood by the movement of plate 24 shown in FIGS. 4*a* to 4*c*.

Pump 10 also includes a controller 56 configured to control the flow of the current through electrical windings 26 to rotate the rotor. In this embodiment, controller 56 is in the form of transistors on control board for electrically commutating and controlling pump 10. Alternately, the controller can be remote and connected to windings 26 by wires.

In the embodiment shown in FIGS. 1 to 4*c*, pump 10 is a gerotor pump; however, in other embodiments, a similar construction may be made with other pump types, including an internal gear pump or a vane pump.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A pump comprising:

a fluid inlet section;

a fluid outlet section;

a stator axially between the fluid inlet section and the fluid outlet section;

a rotor axially between the fluid inlet section and the fluid outlet section, the rotor and the stator defining a fluid flow space radially therebetween;

an inlet guide rotatable with respect to the stator about an axis of the rotor and configured for guiding fluid flow from the fluid inlet section into the fluid flow space; and an outlet guide rotatable with respect to the stator about the axis of the rotor and configured for guiding fluid flow from the fluid flow space into the fluid outlet section, the rotor being rotatable inside of the stator by electromagnetic forces urging the rotor towards the stator, rotation of the rotor inside the stator and rotation of the inlet guide and the outlet guide creating a pressure in a first portion of the fluid flow space that forces fluid from the fluid flow space through the fluid outlet section and creating a vacuum in a second portion of the fluid flow space that pulls fluid from the fluid inlet section into the fluid flow space, the inlet guide and the outlet guide being fixed together by a pin passing axially through the rotor, the pin defining the axis of the rotor, the inlet guide and outlet guide being eccentrically oriented with respect to the pin such that each of the inlet guide and outlet guide includes a first radially extending surface and a second radially extending surface that is shorter than the first radially extending surface.

2. The pump as recited in claim 1 wherein, during rotation of the rotor inside the stator, the inlet guide is configured to move to align the second portion of the fluid flow space with the fluid inlet section and the outlet guide is configured to move to align the first portion of the fluid flow space with the fluid outlet section.

3. The pump as recited in claim 2 wherein the inlet guide is an inlet plate and the outlet guide is an outlet plate.

4. The pump as recited in claim 2 wherein the rotor is eccentrically mounted within the stator for rotation.

5. The pump as recited in claim 4 wherein the rotor is eccentrically fixed to the inlet guide and the outlet guide such that rotation of the rotor about the axis of the rotor in a first rotational direction causes the inlet guide and the outlet guide to rotate about the axis of the rotor in a second rotational direction opposite the first rotational direction.

6. The pump as recited in claim 1 wherein, as viewed axially, the inlet guide and the outlet guide cover different cross-sections of the fluid flow space during operation as the inlet guide and the outlet guide rotate about the pin.

7. The pump as recited in claim 6 wherein the inlet guide and the outlet guide each include a guide portion having a semicircular cross-section when viewed axially.

8. The pump as recited in claim 1 wherein the stator includes at least four electrical windings configured for receiving current to generate the electromagnetic forces for urging the rotor towards the stator to rotate the rotor.

9. The pump as recited in claim 8 further comprising a controller configured to control the flow of the current through the at least four electrical windings to rotate the rotor.

10. The pump as recited in claim 1 wherein the fluid inlet section includes an annular groove for guiding a lip of the inlet guide during rotation of the inlet guide and/or the fluid outlet section includes an annular groove for guiding a lip of the outlet guide during rotation of the outlet guide.

11. The pump as recited in claim 1 wherein the inlet guide sits flush against a first radially extending axial facing surface of the stator and a first radially extending axial facing surface of the rotor and the outlet guide sits flush against a second radially extending axial facing surface of the stator and a second radially extending axial facing surface of the rotor.

12. An automotive vehicle transmission comprising the pump recited in claim 1.

13. A method of forming a pump comprising:

providing a rotor radially inside of a stator;

rotatably fixing an inlet guide to a first axial side of the rotor, the inlet guide being rotatable with respect to the stator about an axis of the rotor;

rotatably fixing an outlet guide to second axial side of the rotor, the outlet guide being rotatable with respect to the stator about the axis of the rotor;

providing a fluid inlet section upstream of the inlet guide; and providing a fluid outlet section downstream of the outlet guide, the rotor and the stator defining a fluid flow space radially therebetween, the inlet guide configured for guiding fluid flow from the fluid inlet section into the fluid flow space, the outlet guide configured for guiding fluid flow from the fluid flow space into the fluid outlet section, the rotor being rotatable inside of the stator by electromagnetic forces urging the rotor towards the stator, rotation of the rotor inside of the stator and rotation of the inlet guide and the outlet guide creating a pressure in a first portion of the fluid flow space that forces fluid from the fluid flow space through the fluid outlet section and creating a vacuum in a second portion of the fluid flow space that pulls fluid from the fluid inlet section into the fluid flow space, the inlet guide and the outlet guide being fixed together by a pin passing axially through the rotor, the pin defining the axis of the rotor, the inlet guide and outlet guide being eccentrically oriented with respect to the pin such that each of the inlet guide and outlet guide includes a first radially extending surface and a second radially extending surface that is shorter than the first radially extending surface.

14. The method as recited in claim 13 wherein, during rotation of the rotor, the inlet guide is configured to move to align the second portion of the fluid flow space with the fluid inlet section and the outlet guide is configured to move to align the first portion of the fluid flow space with the fluid outlet section.

15. The method as recited in claim 14 wherein the inlet guide is an inlet plate and the outlet guide is an outlet plate.

16. The method as recited in claim 14 wherein the rotor is eccentrically mounted within the stator for rotation.

17. The method as recited in claim 16 wherein the rotatably fixing the inlet guide to the first axial side of the rotor and the rotatably fixing the outlet guide to the second axial side of the rotor includes eccentrically fixing the rotor to the inlet guide and the outlet guide such that rotation of the rotor about the axis of the rotor in a first rotational direction causes the inlet guide and the outlet guide to rotate about the axis of the rotor in a second rotational direction opposite the first rotational direction.

18. The method as recited in claim 17 wherein the inlet guide and the outlet guide are fixed together by a pin passing axially through the rotor, the pin defining the axis of the rotor.

19. A pump comprising:

a fluid inlet section;

a fluid outlet section;

a stator axially between the fluid inlet section and the fluid outlet section;

a rotor axially between the fluid inlet section and the fluid outlet section, the rotor and the stator defining a fluid flow space radially therebetween;

an inlet guide rotatable with respect to the stator about an axis of the rotor and configured for guiding fluid flow from the fluid inlet section into the fluid flow space; and an outlet guide rotatable with respect to the stator about the axis of the rotor and configured for guiding fluid flow from the fluid flow space into the fluid outlet section, the rotor being rotatable inside of the stator by electromagnetic forces urging the rotor towards the stator, rotation of the rotor inside the stator and rotation of the inlet guide and the outlet guide creating a pressure in a first portion of the fluid flow space that forces fluid from the fluid flow space through the fluid outlet section and creating a vacuum in a second portion of the fluid flow space that pulls fluid from the fluid inlet section into the fluid flow space, wherein the inlet guide and the outlet guide are supported relative to the rotor such that rotation of the rotor about an axis of the rotor in a first rotational direction causes the inlet guide and the outlet guide to rotate about the axis of the rotor in a second rotational direction opposite the first rotational direction such that high and low pressure sides are continuously moving around the stator and the inlet guide and the outlet guide rotate about the axis in the second rotational direction to align the high pressure side with the fluid outlet section and the low pressure side with the fluid inlet section.

20. The pump as recited in claim 19 wherein, as viewed axially, the inlet guide and the outlet guide are arranged in a complementary manner to form a circle and cover different cross-sections of the fluid flow space during operation as the inlet guide and the outlet guide rotate about a pin fixing the inlet guide and the outlet guide together.

* * * * *